United States Patent [19]

Miller

[11] 4,397,056

[45] Aug. 9, 1983

[54] POWER ASSISTED TOILET BRUSH

[75] Inventor: Albert J. Miller, Campbell, Calif.

[73] Assignee: Atlas Electronics International, Inc., Santa Clara, Calif.

[21] Appl. No.: 320,659

[22] Filed: Nov. 12, 1981

[51] Int. Cl.[3] ..... A46B 13/04

[52] U.S. Cl. ..... 15/22 R

[58] Field of Search ..... 15/22 R, 22 A, 22 C, 15/23, 24, 28, 29, 97; 310/50

[56] References Cited

U.S. PATENT DOCUMENTS

| | | | |
|---|---|---|---|
| 3,370,214 | 2/1968 | Aymar | 15/22 R X |
| 3,892,004 | 7/1975 | Downes | 15/24 X |
| 3,968,789 | 7/1976 | Simoncini | 15/22 R X |
| 4,189,801 | 2/1980 | Lanusse | 15/22 R |
| 4,208,753 | 6/1980 | Lewis | 15/29 |
| 4,217,671 | 8/1980 | Rand | 15/24 |
| 4,254,526 | 3/1981 | Fromm | 15/24 |

FOREIGN PATENT DOCUMENTS

| | | | |
|---|---|---|---|
| 2019003 | 11/1971 | Fed. Rep. of Germany | 15/22 R |
| 2350898 | 4/1974 | Fed. Rep. of Germany | 15/22 R |

*Primary Examiner*—Edward L. Roberts

*Attorney, Agent, or Firm*—Harris Zimmerman; Howard Cohen

[57] ABSTRACT

A power assisted device for cleaning toilet bowls includes an elongated stem portion having a brush at the distal end thereof, and a spray outlet port proximate to the brush. The brush is joined to a reciprocally rotating shaft extending through the stem to provide agitation to the brush. At the proximal end of the stem, a housing includes a pump connected between a liquid cleanser tank and a tubing extending from the pump to the spray outlet. The housing includes rechargeable batteries to drive the pump and a motor assembly which drives the brush.

9 Claims, 6 Drawing Figures

POWER ASSISTED TOILET BRUSH

BACKGROUND OF THE INVENTION

Cleanliness and sanitation are two hallmarks of civilization. Many centuries ago, the Roman empire constructed aquaducts and rudimentary sewage systems to carry water into Rome and carry waste away. Early Puritans here in America, claimed that "cleanliness is next to Godliness". The rate of post-operative deaths dropped dramatically when it was established that sterilization of the doctor's hands and of the operation site before the operation had a direct relation to the patient's recovery. Therefore, cleanliness makes sense to most people for a variety of reasons: the appearance of cleanliness is appealing; cleanliness signifies a degree of refinement; and cleanliness is necessary for sound hygene and sanitary practices.

Today in western civilization, most of us are accustomed to and expect cleanliness in homes, hotels, and even the service stations that we frequent. A filthy washroom in a commercial establishment is both disgusting and unforgettable, particularly if it is in a restaurant. Over the years, many national oils companies have realized the positive attraction of clean restrooms in their service stations and consequently base a portion of their advertising budget on a claim for spotless washrooms. Other commercial establishments have followed suit, realizing that spotless restroom facilities are essential not only for health reasons, but also as a statement of the general service to their customers, by they diners, hotel guests, or movie watchers.

In the domestic area, housewives and single people are also concerned with maintaining a clean bathroom. Again, there is the omnipresent concern for health reasons, particularly if there are small children present in the home. No American is unaware of the state of the bathroom when visitors arrive: the proliferation of toilet bowl cleaners, deodorizers, and blueing agents on the market attest to the public's desire for a clean bathroom.

Unfortunately, due to the basic design of the toilet, it is difficult to keep it clean for any period of time. The area around the inside rim of the toilet bowl is virtually inaccessible, and invites the lodging and multiplication of waste bacteria and germs. Therefore, even a toilet that looks clean may not be truly sterile, as the bacteria clings to the underside of the rim. The more clean this troublesome area is, the longer the entire toilet bowl looks and stays clean.

It is known in the prior art to use a brush and caustic cleaning compound to achieve manual cleaning of soiled porcelain surfaces of the toilet bowl.

SUMMARY OF THE PRESENT INVENTION

The present invention generally comprises a power assisted device for cleaning toilet bowls. It includes an elongated stem portion having a brush at the distal end thereof, and a spray outlet port proximate to the brush. The brush is joined to a reciprocally rotating shaft extending through the stem to provide agitation to the brush. At the proximal end of the stem, a housing includes a pump connected between a liquid cleanser tank and a tubing extending from the pump to the spray outlet. The housing includes a motor assembly which drives the brush, and a rechargable battery which energizes the pump and the motor assembly.

A BRIEF DESCRIPTION OF THE DRAWINGS

DESCRIPTION OF THE PREFERRED EMBODIMENT

Figure 2:
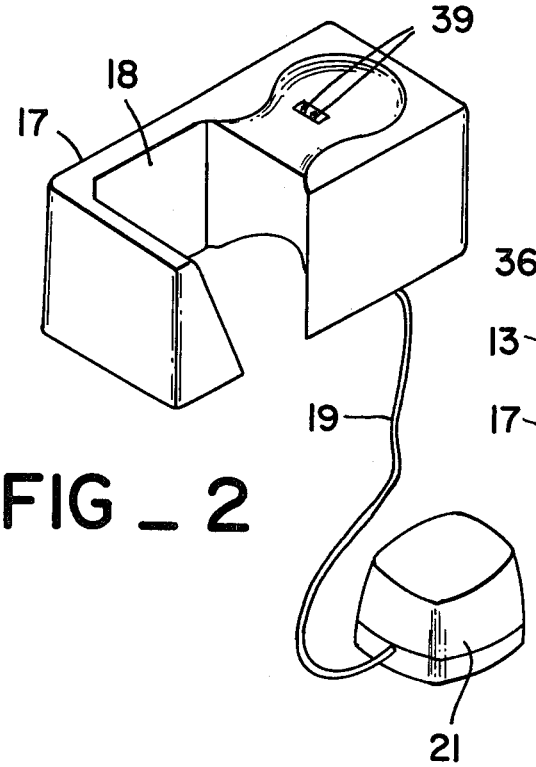
FIG. 2 is a perspective view of the device holder and recharging assembly of the present invention.
Figure 3:
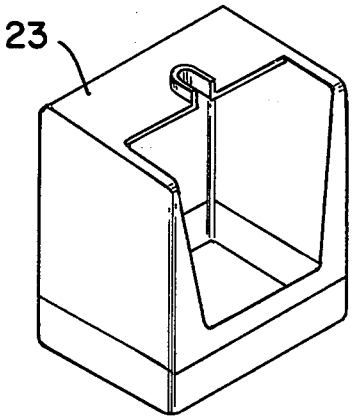
FIG. 3 is a perspective view of the drip container for use in conjunction with the device of the present invention.
Figure 1:
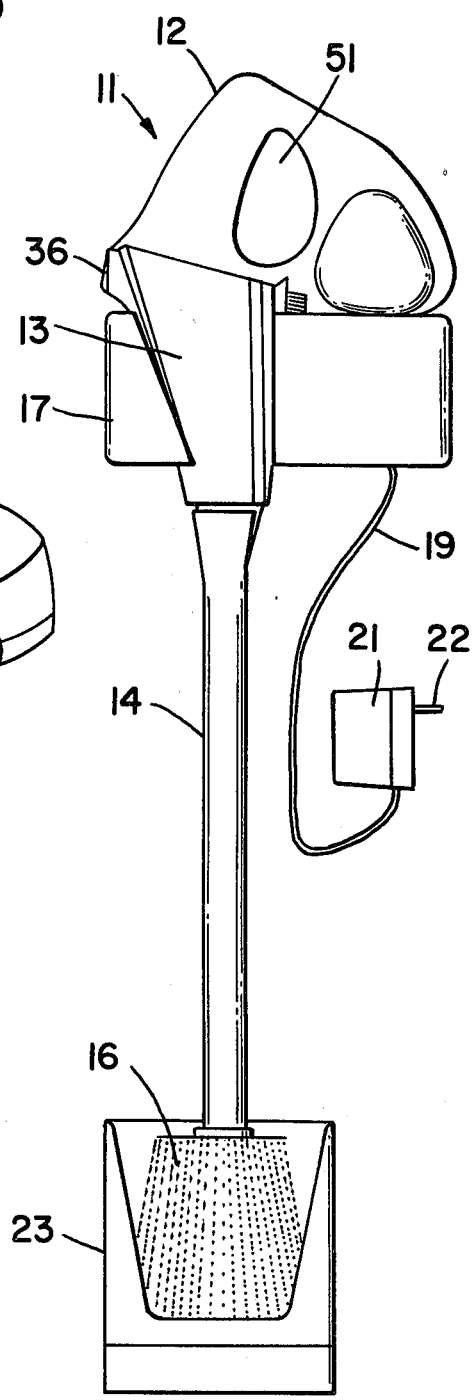
FIG. 1 is a plan elevation of the power assisted brush assembly of the present invention.

The present invention generally comprises a power assisted device for cleaning and santitizing such items as toilet bowls, sinks, bidets, and the like. A salient feature of the present invention is the provision of meas for applying cleaning compounds to the surfaces to be cleaned, in conjunction with a brush assembly which is motor driven to scrub the offensive surfaces. As shown in FIG. 1, the present invention includes the power assisted device 11 which comprises a handle portion 12, a housing portion 13, an elongated stem portion 14 extending from the housing, and a brush portion 16 secured to the distal end of the stem portion 14.

The invention also includes a bracket assembly 17 which is adapted to support the device 11. The bracket 17 is adapted to be secured to a wall surface or the like, and includes an irregularly shaped slot 18 formed therein and adapted to receive and retain the downwardly tapering portion of the housing 13, as well as portions of the handle assembly 12. Connected to the bracket assembly 17 by means of an electrical cable 19 is a transformer assembly 21. The transformer assembly includes a plug 22 for engaging a wall receptacle, the transformer assembly including a rectifier for supplying direct current power at reduced voltage to a contact assembly within the slot 18 which is provided to recharge batteries within the device 11, as will be explained in the following.

Figure 4:
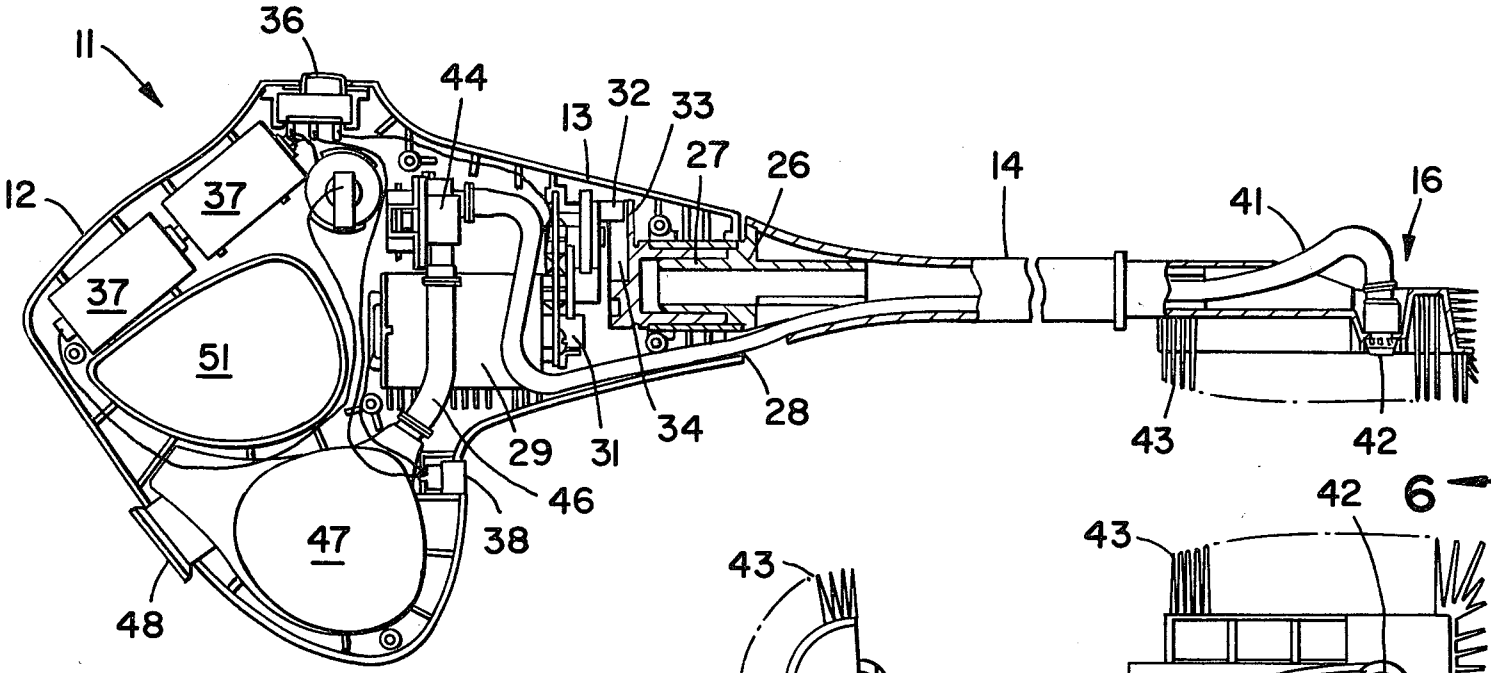
FIG. 4 is a cross-sectional view of the power assisted device of the present invention.
Figure 5:
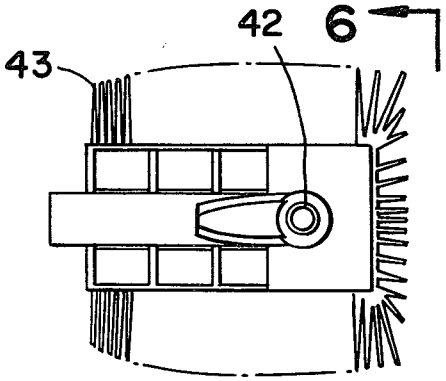
FIG. 5 is a detailed plan view of the brush portion of the device of the present invention.

The present invention also provides a drip container 23, which is essentially a box having a hole therein to receive the brush 16 and contain any offensive excrudations therefrom. With reference to FIG. 4, it may be appreciated that the stem portion 14 of the device 11 is joined to the housing 13 in reciprocally rotatable fashion. The stem portion 14 generally comprises a hollow, tubular member having the brush portion 16 joined to one end thereof. Extending from the other end of the stem portion 14 is a cylindrical tubular adaptor 26. The distal end of the adaptor 26 is received within a bushing 27 which is rotatably supported in the end 28 of the housing 13.

An electric motor 29 is supported within the housing portion 13, with the output of the motor 29 connected to a gear reduction assembly 31. The output of the gear reduction assembly 31 comprises an eccentric roller 32 extending from a rotating gear and received within a channel 34 of an arm 33. The arm 33 extends radially from the inner end of the bushing 27, the slot 34 and arm 33 serving to convert the rotary motion of the roller 32 into reciprocating rotary motion imparted to the bushing 27, the adaptor 26, and thence to the stem portion 14.

The motor 29 is actuated by a manual switch 36 secured to the housing portion 13. A pair of rechargeable electrical energy cells 37 are supported within the handle portion 12, and are connected through the switch 36 to the motor 29. Secured to the handle portion 12 and extending outwardly therefrom are a pair of electrical contacts 38. The contacts 38 are electrically connected to the energy cells 37, and are positioned to impinge upon the recharging electrodes 39 which are supported in the bracket 17. Thus, when the device 11 is returned to the bracket 17 for storage, the impingement of the contacts 38 of the device 11 and the contacts 39 of the bracket 17 complete a charging circuit from the transformer 21 to recharge the energy cells 37. Thus the device 11 is ready to be used at all times.

Figure 6:
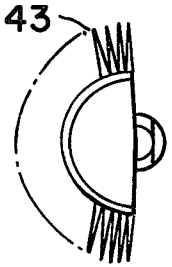
FIG. 6 is an end view of the brush portion of the invention, taken along line 6—6 of FIG. 5.

Extending the length of the stem portion 14 is a resilient tube 41. The distal end of the tube 41 is joined to a spary emitter 42 which is disposed among the bristles 43 of the brush portion 16. As shown in FIG. 6, the bristles 43 extend from the brush portion 16 over an arcuate surface which describes an angle of approximately 180°.

The proximal portion of the flexible tube 41 extends into the housing portion 13 at the end 28 thereof, and is connected to the output of an electrically operated pump 44 secured within the housing portion 13. The intake of the pump 44 is connected via a short tube 46 to a tank 47 disposed within the handle portion 12. The tank 47 is provided with a resealable exterior port 48 which is adapted to receive a suitable cleaning compound. The pump 44 is also connected through the switch 36 to the energy cells 37. The switch 36 permits operation of the pump 44 during operation of the motor 29 so that the cleaning solution stored in the tank 47 may be ejected through the spray emitter 42 while the bristles 43 are rotated reciprocally to scrub the surfaces of the toilet bowl.

The handle portion 12 is provided with a hand hole 51 extending therethrough and adapted to receive the fingers of a hand therethrough for purposes of grasping the handle portion 12. The device may be lifted from the bracket 17 and the tank 47 filled through the port 48 with any appropriate cleaning solution. The button 36 may then be employed to actuate the motor 29 and the pump 44 to drive the brush portion 16 and to spray the cleaning solution through the emitter 42. When the cleaning task is completed, the device may be returned to its wall bracket 17 for recharging of the energy cells 37 and for storage until subsequent use. The drainage container 23 may be disposed directly below the bracket 17 so that the brush portion 16 will be stored therein.

I claim:

1. A power assisted cleaning device, comprising a portable housing, a stem assembly joined to said housing in freely reciprocating fashion, a cleaning brush secured to the distal end of said stem assembly, motor means disposed in said housing for driving said stem assembly in reciprocating rotary motion, a spray jet disposed adjacent to said brush, liquid reservoir means in said housing for holding a cleaning solution therein, pump means in said housing and connected between said reservoir and said spray jet for pumping liquid cleaning solution to said spray jet, rechargable battery means disposed within said housing for energizing said pump means and said motor means, wall bracket means for supporting said device, said bracket means including recharging means for recharging said battery means, said wall bracket means including a wall-mounted bracket having a tapered slot extending generally vertically therethrough and adapted to receive a like tapered portion of said portable housing therein, said stem assembly extending downwardly therethrough in suspended fashion, said wall mounted bracket including electrical contacts projecting therefrom and disposed to contact recharging contacts on the exterior of said portable housing.

2. The device of claim 1, wherein said pump means includes a flexible delivery tube extending from said housing through said stem assembly to said spray jet.

3. The device of claim 1, further including switch means mounted on said housing for selectively actuating said pump and said motor means.

4. The device of claim 1, wherein said brush includes bristles extending outwardly therefrom over a continuous surface extending approximately 180° and disposed generally symmetrically with respect to the axis of said stem assembly.

5. The device of claim 4, wherein said spray jet is disposed among said bristles and is directed outwardly therefrom.

6. The device of claim 1, wherein said stem assembly includes a shaft rotatably secured in said housing, and a cam arm extending radially from said shaft.

7. The device of claim 6, wherein said motor means includes a gear reduction assembly connected to the output thereof, said gear reduction assembly including an eccentric arm extending from a rotating portion thereof and engaging said cam arm to drive said cam arm in reciprocal rotation.

8. The device of claim 1, further including external port means in said housing for refilling said reservoir means.

9. The device of claim 1, further including a handle hole extending entirely through said portable housing and configured to permit manual gripping of said device.

* * * * *